United States Patent [19]

Munn et al.

[11] Patent Number: 4,836,426

[45] Date of Patent: Jun. 6, 1989

[54] CARRYING CASE FOR PROTECTIVE CLOTHING

[76] Inventors: Robert A. Munn, 1921 Belcher Dr.; Valerie L. Minor, 700 Hyatt Ct S. #11, both of Columbus, Ohio 43224

[21] Appl. No.: 73,061

[22] Filed: Jul. 13, 1987

[51] Int. Cl.[4] ..... A45F 3/02

[52] U.S. Cl. ..... 224/206; 224/202; 224/208; 224/209; 224/259

[58] Field of Search ..... 224/208, 209, 206, 202, 224/257, 258, 259, 222, 267, 205

[56] References Cited

U.S. PATENT DOCUMENTS

| | | | |
|---|---|---|---|
| 1,345,864 | 7/1920 | Lethern | 224/202 |
| 2,224,568 | 12/1940 | Altorfer | 224/151 |
| 4,655,343 | 4/1987 | Lane et al. | 224/153 |

FOREIGN PATENT DOCUMENTS

| | | | |
|---|---|---|---|
| 2589339 | 5/1987 | France | 224/202 |
| 1009398 | 11/1965 | United Kingdom | 224/209 |

*Primary Examiner*—Renee S. Luebke

*Attorney, Agent, or Firm*—Biebel, French & Nauman

[57] ABSTRACT

A bag for protective clothing is provided for use in conjunction with what is known as mission oriented protective posture gear. This generally cylindrical container structure includes a primary container having front and rear panels, a side wall and an aperture in the front panel, a secondary container located on the surface of the primary container such that an auxiliary aperture is formed there between and a plurality of straps attached to the primary container. At least one strap has both of its ends connected to the front panel of the primary container while a second strap has its ends connected to the front and rear panels respectively of the primary container. In the preferred form of the embodiment a third strap is also utilized with its ends both being connected to the rear panel of the primary container.

12 Claims, 3 Drawing Sheets

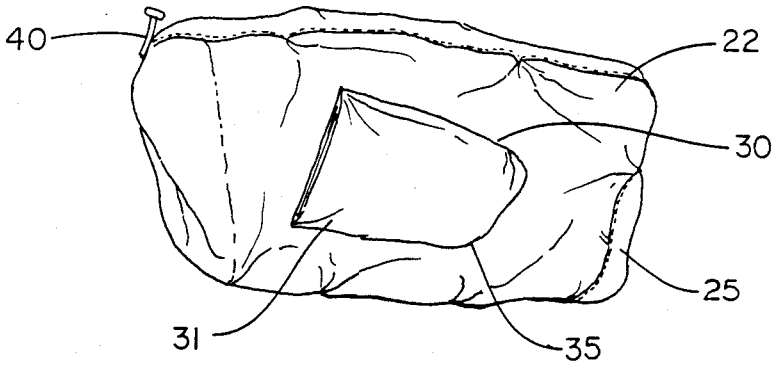
FIG. 4
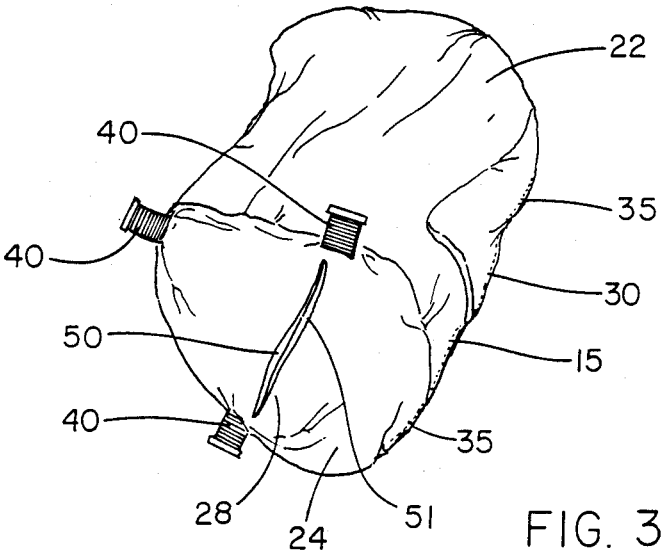
FIG. 3
FIG. 5
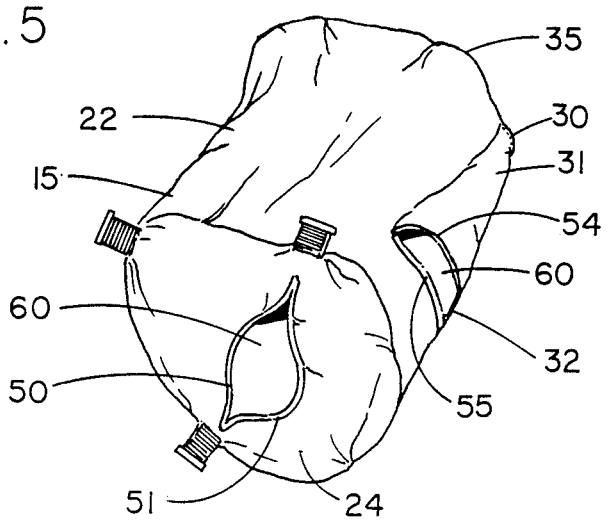

CARRYING CASE FOR PROTECTIVE CLOTHING

FIELD OF THE INVENTION

This invention relates to a carrying case and more specifically to a container for the temporary storage of protective clothing.

BACKGROUND OF THE INVENTION

This invention is directed to the providing of a suitable container which is designed to be utilized in combination with Mission Oriented Protective Posture gear (MOPP gear). The container structure is not part of the MOPP gear nor does it supply any protection for the user, but it is only intended to supplement the MOPP gear currently being utilized.

MOPP gear is utilized by individuals to protect the wearer against the harmful effects of nuclear, chemical or biological warfare or chemical or nuclear accidents. MOPP gear can be utilized by civilians as well as persons in military service. Civilian applications where MOPP gear is used would include the chemical industry, the health and safety industry, and persons engaging in survivalist-type outdoor activities.

MOPP gear is comprised of an overgarment consisting basically of a pair of trousers and a jacket, a pair of overboots, a pair of gloves and a mask/hood. The overboots are worn, as the name indicates, over boots or the normal footwear. Depending on the type of situation, an individual may need to don only the overgarment, or the overboots in combination with the overgarment, or the mask/hood, overboots and overgarment or all the components of MOPP gear. As can be appreciated from a consideration of the circumstances which accompany the potential need to use MOPP gear, the severity of the situation can undergo drastic and immediate change.

To ensure the safety of those exposed to chemical nuclear or biological contaminants, standards have been established with respect to the time in which a person must don his or her MOPP gear to avoid the potential for harm. The threshold standard which has been established is one which requires the MOPP gear to be put on in a particular order within a time constraint of less than 8 minutes. The problem is compounded, however, by the fact that individuals carrying MOPP gear may also be involved in other tasks which necessitate the use of their hands. To better understand the problem, currently for example, the mask/hood utilized in MOPP gear is distributed to users in a carrying case. However, no such provisions are made with respect to the other components of MOPP gear. Current methods of taking MOPP gear into situations where it may be needed include (1) holding the MOPP gear in one or both hands, (2) putting the MOPP gear in a plastic bag and slinging it over one's shoulder or (3) using the laces of the overboots to tie all the MOPP gear together, and then secure it by means of the laces to an individual's belt.

The only known attempt to develop a container for storage of all the MOPP gear has resulted in a device similar to a minibackpack with the unit being worn in a position such that it would be adjacent the small of the back. None of these proposed solutions to the problem is efficient. The capability of the individual to use his or her hands is severely curtailed when using either of the first two options. Meanwhile, attempting to utilize the latter two options results in a time-consumming experience in the event that the MOPP gear must be worn, with time being crucial.

Given the increasing frequency of nuclear and chemical accidents, and the threat of nuclear, chemical, or biological warfare, a device which will accelerate the dressing process and enhance an individual's chances for survival is desperately needed.

SUMMARY OF THE INVENTION

In accordance with this invention a container structure is provided for advantageous use in conjunction preferably with Mission Oriented Protective Posture gear (MOPP gear). The container itself as well as the straps is preferably formed from appropriate fabrics, although it is not anticipated that these two fabrics would be the same.

The two primary components of this invention are a primary container and a plurality of straps which permit the container to be worn by the user. The generally cylindrical container is positioned so as to be worn at the left side of the user's waist. A portion of the outwardly facing side wall is utilized in the formation of an auxiliary container. The forward portion of both the auxiliary container and the primary container include apertures large enough for articles of clothing to pass through. In its intended use, a pair of gloves is stored in the auxiliary container. Meanwhile overboots and an overgarment, which consists of a pair of trousers and a jacket, may be stored in the primary container.

Each of the two apertures utilize cooperative fastening means to permit the closure of the bag in the event that its contents are not needed. Each of the straps includes an adjustment means as well as an attachment means to assist in the utilization of this product.

The primary objective of this invention is to provide a carrying case for protective clothing that can accommodate the various components of MOPP gear, thereby freeing the hands of the potential utilizer of such gear. An important aspect of this objective is to design this bag as to minimize discomfort while maximizing effectiveness and efficiency. This important objective is furthered by the location of the container on the wearer's body as well as by the relative placement of the apertures associated with both the primary and auxiliary containers.

Another objective of this invention is to provide a suitable container for protective clothing, which container does not detract from the performance of the individual wearing it. This important objective is furthered by the use of a plurality of straps to maintain the bag in a relatively close fitting relationship to the body of the wearer. This important objective is also furthered by the fabrication of the container from a lightweight and pliable material that can permit the container to be worn beneath the overgarments of the wearer without causing undue discomfort.

Another objective of this invention is to provide a bag for protective clothing that is of extremely economical construction and is particularly easy to utilize in a functional operational relationship by an individual. An important aspect of this is the ease with which the carrying case can be donned.

These and other objects and advantages of this invention will be readily apparent from the following detailed description of an illustrative embodiment thereof. Reference will be had to the accompanying drawings which illustrate the embodiment of the invention.

DESCRIPTION OF THE INVENTION

FIG. 3 is a front elevational view on a greatly enlarged scale of the invention without the straps being shown.

FIG. 4 is a side plan view on a greatly enlarged scale showing the right side of the device shown in FIG. 3.

FIG. 5 is a front elevational view on a greatly enlarged scale similar to FIG. 3 but showing the first and auxiliary apertures opened.

DESCRIPTION OF THE ILLUSTRATIVE EMBODIMENT

Figure 1:
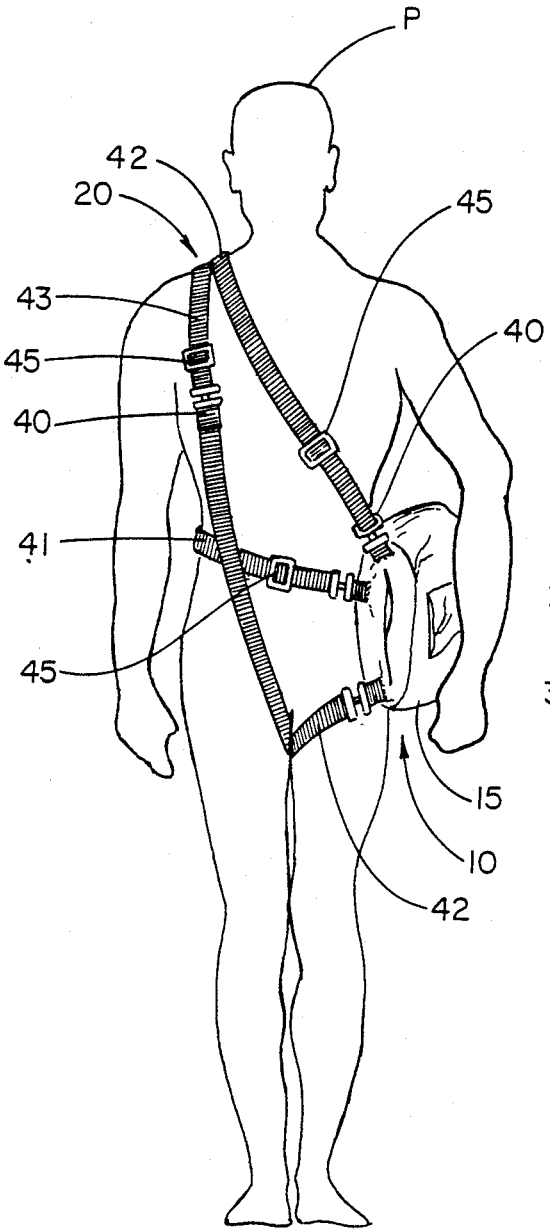
FIG. 1 is a front elevational view of an individual provided with an embodiment of the container for protective clothing disclosing our new invention.

Having reference to the drawing attention is directed first to FIG. 1 which illustrates a bag for protective clothing embodying this invention and shown in operative relationship with respect to an individual P, said bag designated generally by the numeral 10. As can be seen from the drawing the bag 10 is comprised of a primary container 15 and a plurality of straps 20 to result in a structure that can be worn adjacent to the left side of the waist of the wearer. This can also be seen in FIG. 2 which is a view shown taken from the back side of the wearer.

The primary container 15 has as its main components a side wall 22 and front and back panels 24 an 25 respectively. Thus in the preferred embodiment, the primary container 15 is of a cylindrical configuration. This is primarily due to economy of manufacture and the relative ease with which a primary container 15 so designed may be compressed once the protective clothing has been removed. However, there could be a plurality of side walls so as to results in the forming of, for example, a rectangular container.

The most visible feature of the front panel 24 is a first aperture 28 which is shown in FIG. 1, as well as in FIG. 3, as being positioned along the vertical axis of front panel 24. Ideally this first aperture 28 extends almost the entire height of front panel 24 so as to minimize any difficulty encountered in attempting to remove the protective clothing from within bag 10.

Positioned on the outwardly facing portion of side wall 22 when the bag is installed in its operative relationship, is auxiliary container 30. Auxiliary container 30 includes auxiliary container side wall 31 as well as a second aperture 32, said aperture being located between auxiliary contained side wall 31 and side wall 22. The auxiliary container is small relative to primary container 15. Similarly second aperture 32 is not as large as first aperture 28. In the preferred embodiment of the invention as shown in FIGS. 3, 4 and 5 the auxiliary container 30 is of a non-rectilinear shape. Furthermore the axis of the second aperture 32 is skew with respect to both the vertical and longitudinal axes of primary container 15. Since the preferable material for the fabrication of primary container 15 is probably a canvas or the same fabric as is used in the protective mask carrier, the various components of primary container 15 would be secured to one another by stitching 35 or other suitable securing means.

Figure 2:
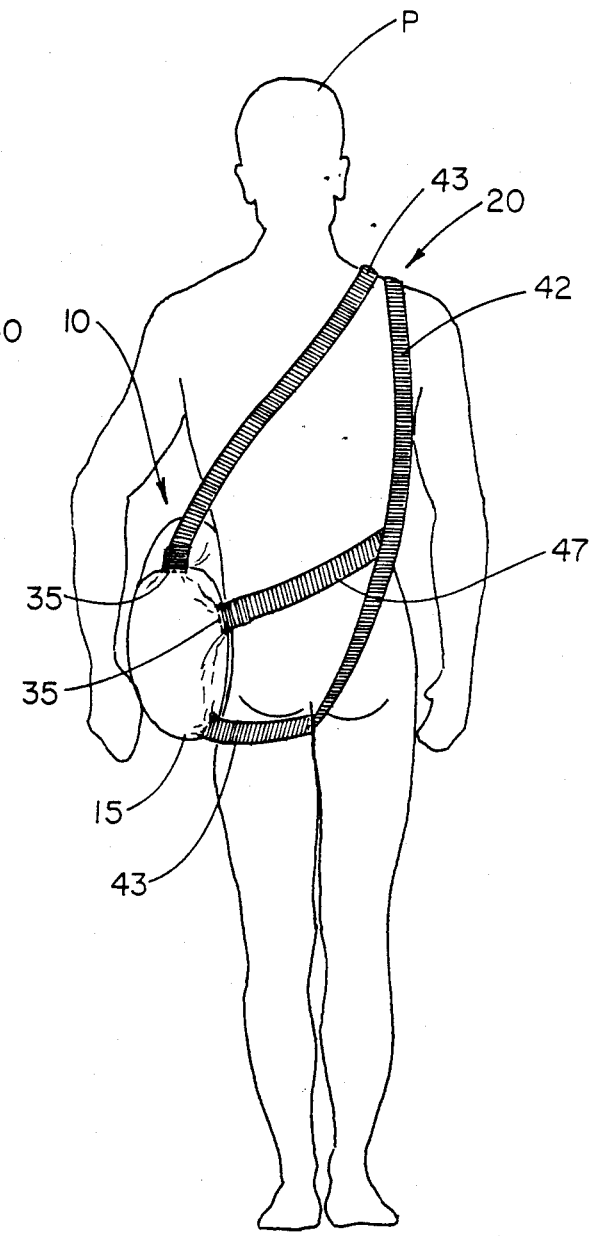
FIG. 2 is a rear elevational view thereof.

Attached on or near front panel 24 are strap attachment means 40. These strap attachment means 40 may be secured directly to the primary container 15 or may have a portion of a strap serve as an intermediary between themselves and primary container 15. These strap attachment means 40 are used to secure straps 20 in operative relationship to primary container 15. In the preferred embodiment of the invention as shown in FIGS. 1 and 2 the straps 20 include a first strap 41, a second strap 42 and a third strap 43. Each of the straps 20 has adjustment means 45 of the type conventionally found to enable a proper fit to be achieved. Similarly the strap attachment means 40 could be any number of conventional means for securing portions of a strap to one another, such as D-rings.

First strap 41 has its opposite ends secured to the opposite ends of primary container 15. One end of first strap 41 is attached on or near to front panel 24 while the other end is attached on or near to back panel 25. The places of attachment for first strap 41 are at or just slightly above the vertical mid-point of the primary container 15 and are at or near the juncture between the respective panels and side wall 22. Thus installed, first strap 41 is positioned to be worn at approximately the wearer's waist in a primarily horizontal position.

Second strap 42 utilizes a pair of strap attachment means 40. One of the strap attachment means utilized in conjunction with second strap 42 is positioned on or near front panel 24 preferably along the vertical axis of primary container 15 so as to be directly above first aperture 28. The opposite end of second strap 42 is secured on or near to the lower portion of front panel 24. Second strap 42 as shown thus extends across the chest of the wearer, over the right shoulder, down the back side of the wearer, and thence through the legs so as to permit its passing over the left, or opposite, thigh for attachment to the bottom portion of front panel 24. Second strap 42 assists in maintaining primary container 15 in a relatively stable position. Furthermore, it tends to bias the primary container 15 towards the front of the individual wearer.

Third strap 43 has its strap attachment means 40 located on the portion of the strap which passes across the chest of the wearer. This location is made necessary due to the fact that the opposite ends of this third strap 43 are secured on or near to the back panel 25 of primary container 15. Third strap 43 thus further stabilizes primary container 15 while providing a biasing towards the rear. A first portion of strap 43 as shown proceeds from near the top of the rear panel of primary container 15 across the back, over the right shoulder and down across the right side of the chest where it is joined to the second portion of the strap which passes through the legs and across the back portion of the left leg where the strap is then secured to the lower rear portion of the primary container.

The first aperture 28 has a pair of side flaps 50 and 51 respectively, which are mechanically interconnected. Similarly, with respect to the auxiliary container 30, a second aperture side flap 54 is capable of interacting with cooperative fastening means 55 which may either be located on the outwardly facing portion of side wall 22 or incorporated as a portion of auxiliary container 30. Hence, both apertures employ mechanically interconnectable means such as Velcro® fasteners or a zipper to ensure that the bag may be securely closed when the need is not there for the removal of the container's contents. The inside of the primary container features a liner 60 which permits the container to be waterproof. This liner should take the form of a suitable plastic or other water impervious liner. This liner 60 could also be utilized with respect to auxiliary container 30, although it is not as important for the contents of the auxiliary container to remain dry as it is for the contents of primary container 15. Furthermore, it may be desirable to have the fabric used in the front and back panels and side wall of the primary container 15 and the auxiliary container side wall 31 to be of a water repellant nature.

Figure 6:
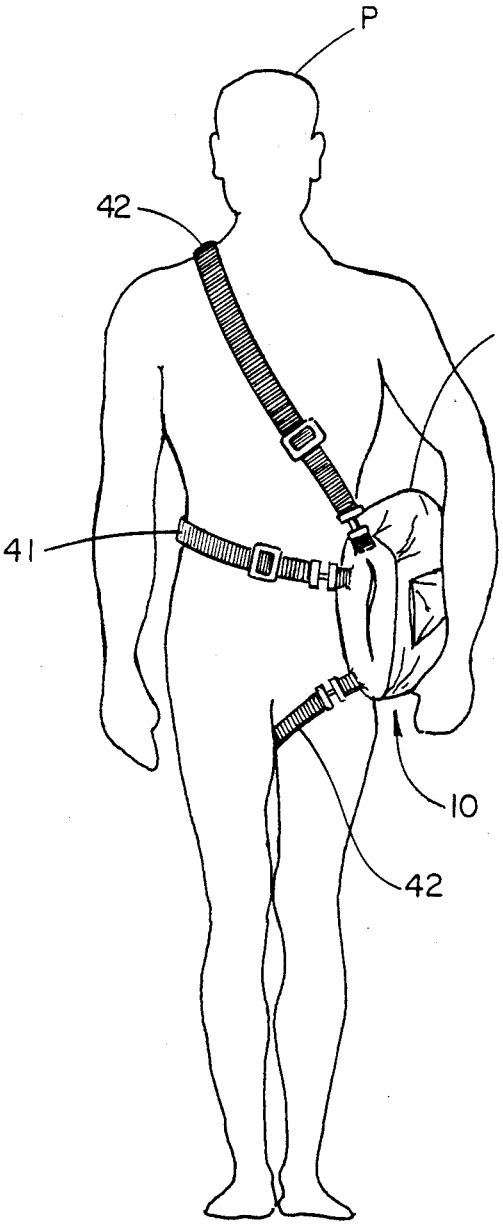
FIG. 6 is a front elevational view similar to FIG. 1 but of a modified structure.
Figure 7:
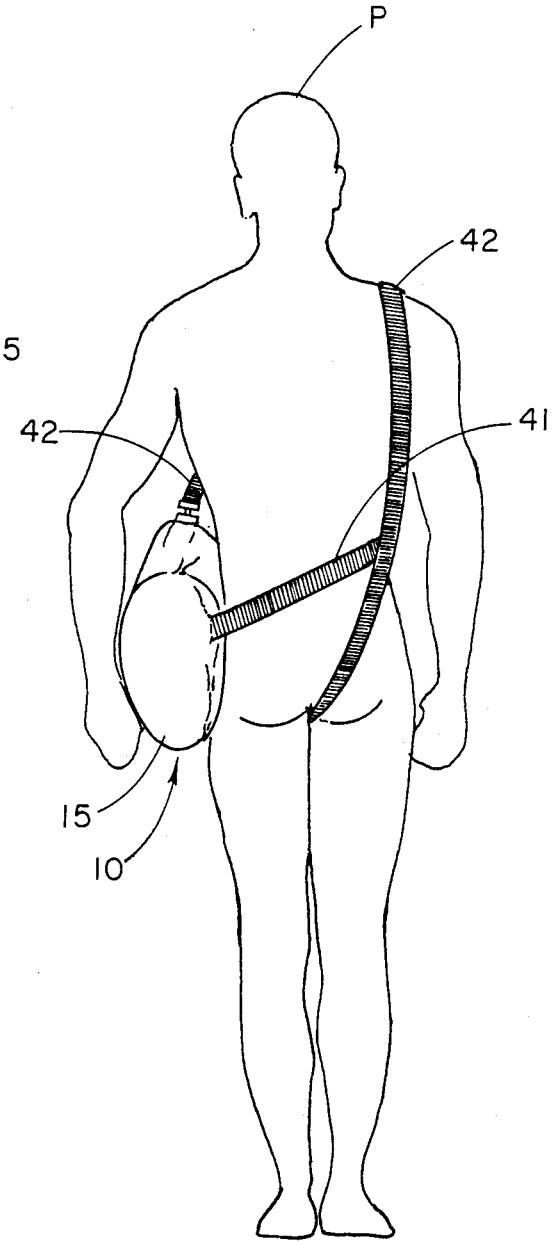
FIG. 7 is a rear elevational view of the modified structure of the invention shown in FIG. 6.

A modified embodiment of the invention is shown in FIGS. 6 and 7. The composition of primary container 15 and auxiliary container 30 are identical to that of the preferred embodiment. However, straps 20 incorporate only first strap 41 and second strap 42.

In use the bag for protective clothing embodying this invention is worn as is shown in the various drawing figures. Inside auxiliary container 30 are the gloves required as a component of the MOPP gear. Inside primary container 15 are the overgarment and the overboots. Specifically, the overboots are put into the primary container 15 first and packed such that they are positioned near the back panel 25. The overgarment consisting of the trousers and jacket is placed into the primary container subsequent to the overboots, such that it is nearest to first aperture 28. In the event that the environmental conditions necessitate the usage of MOPP gear, the wearer need only open first aperture 28 and second aperture 32 to gain access to the entire MOPP gear. In actual usage, the overgarment must be put on first, such that only the first aperture need be opened. If the environmental condition worsens, the next level of preparedness requires that the overboots be donned. Thus, for the first two levels of readiness, the second aperture remains closed. Only when gloves are required does the second aperture have to be opened to permit the donning of the gloves. As the MOPP gear is removed from primary container 15, the fabric composition of the container permits its collapsability against the body of the wearer so as to eliminate any bulkiness previously associated therewith. Additionally, at all times, through the utilization of this invention, the wearer's hands remain free so that they may carry other articles or be available to assist in any operation being conducted.

It will be readily apparent that the foregoing detailed description of illustrative embodiments of this invention that a particularly novel and extremely effective shoulder bag for protective clothing is provided. This device is relatively simple to fabricate and requires a minimal amount of time for donning both of the device and of the protective gear enclosed therein. The bag is economical to fabricate and results in an effective carrier of clothing. Other applications for this invention are numerous and could include use by hunters, mountain climbers, hikers, or joggers for carrying food and/or equipment so as to be readily accessible as opposed to the situation encountered through the use of a backpack. The cooperation between the plurality of straps provides for the snug fit of the primary container against the body, thereby minimizing the chance of snagging as well as limiting the possibility of wear and tear, through contusions and muscle fatigue, to the body of the person making use of this device.

Having thus described this invention, what is claimed is:

1. A bag for protective clothing comprising a primary container, said primary container having a first aperture, a front panel, a rear panel and a side wall, a secondary container, said secondary container located on said sidewall of said primary container, said secondary container having an auxiliary aperture, and a plurality of straps including at least a first strap and a second strap, said first strap being securable about a person's waist such that said first strap is fastened to said front panel and said rear panel, said second strap being securable over a person,s shoulder and about a leg such that said second strap is fastened only to said front panel.

2. A bag for protective clothing according to claim 1, wherein said primary container is of a cylindrical shape.

3. A bag for protective clothing according to claim 1, wherein said first aperture is located on said front panel.

4. A bag for protective clothing according to claim 3, wherein said first aperture has a pair of mechanically interconnectable side walls.

5. A bag for protective clothing according to claim 1, wherein said secondary container has an outer wall, said auxiliary aperture is located between said outer wall and said side wall of said primary container.

6. A bag for protective clothing according to claim 5, wherein said first strap has two ends, with one end being secured directly or indirectly to said front panel of said primary container while the other end is secured directly or indirectly to said rear panel of said primary container.

7. A bag for protective clothing according to claim 6, wherein said second strap has two ends, with both ends being secured directly or indirectly to said front panel of said primary container.

8. A bag for protective clothing according to claim 7, wherein said are front panel, rear panel, and side wall are water repellant.

9. A bag for protective clothing according to claim 8, wherein said primary container has a liner which renders it waterproof.

10. A bag for protective clothing according to claim 7, wherein said first and second straps include fastening means.

11. A bag for protective clothing according to claim 10, wherein said first and second straps are adjustable lengthwise.

12. A bag for protective clothing according to claim 11, wherein said plurality of straps includes a third strap.

* * * * *